US011259977B2

(12) United States Patent
Song et al.

(10) Patent No.: US 11,259,977 B2
(45) Date of Patent: Mar. 1, 2022

(54) UPPER LIMB EXERCISE APPARATUS AND CONTROL METHOD THEREFOR

(71) Applicant: NATIONAL REHABILITATION CENTER, Seoul (KR)

(72) Inventors: Won-Kyung Song, Seoul (KR); Suncheol Kwon, Seoul (KR); Jun Yong Song, Seoul (KR)

(73) Assignee: National Rehabilitation Center, Seoul (KR)

( * ) Notice: Subject to any disclaimer, the term of this patent is extended or adjusted under 35 U.S.C. 154(b) by 171 days.

(21) Appl. No.: 16/640,507

(22) PCT Filed: Jun. 14, 2018

(86) PCT No.: PCT/KR2018/006512
§ 371 (c)(1),
(2) Date: Feb. 20, 2020

(87) PCT Pub. No.: WO2019/039710
PCT Pub. Date: Feb. 28, 2019

(65) Prior Publication Data

US 2021/0059887 A1 Mar. 4, 2021

(30) Foreign Application Priority Data

Aug. 21, 2017 (KR) ..... 10-2017-0105553

(51) Int. Cl.
*A61H 1/02* (2006.01)
*A63B 21/00* (2006.01)
(Continued)

(52) U.S. Cl.
CPC ..... *A61H 1/0274* (2013.01); *A63B 21/00181* (2013.01); *A63B 21/0435* (2013.01);
(Continued)

(58) Field of Classification Search
CPC ..... A61H 1/0274; A61H 2201/1215; A61H 2201/1659; A61H 2201/1284;
(Continued)

(56) References Cited

U.S. PATENT DOCUMENTS

2008/0000317 A1* 1/2008 Patton ..... A61H 1/0237 74/500.5
2008/0304935 A1* 12/2008 Scott ..... A61H 1/0262 414/5

FOREIGN PATENT DOCUMENTS

CN 106512329 A 3/2017
CN 206355516 U 7/2017
(Continued)

*Primary Examiner* — Andrew S Lo
(74) *Attorney, Agent, or Firm* — Rabin & Berdo, P.C.

(57) ABSTRACT

An upper limb exercise apparatus comprises a base, a frame, and a display mounted on the frame. The apparatus further comprises 5-bar linkage-type movable parts positioned on the display and including a first link and a second link. The first link comprises a 1-1 member having one end attached to the frame and being rotationally driven, and a 1-2 member having one end rotatably attached to the other end of the 1-1 member, the other end having attached thereto a handle for gripping. The second link comprises a 2-1 member having one end attached to the frame and being rotationally driven, and a 2-2 member having one end rotatably attached to the other end of the 2-1 member, the other end having attached thereto the handle and the other end of the 1-2 member. Series elastic actuators attached to the 1-1 member and the 2-1 member provide torque.

15 Claims, 7 Drawing Sheets

(51) Int. Cl.

| | |
|---|---|
| ***A63B 21/04*** | (2006.01) |
| ***A63B 21/045*** | (2006.01) |
| ***A63B 71/06*** | (2006.01) |
| *A63B 22/00* | (2006.01) |
| *A63B 71/00* | (2006.01) |

(52) U.S. Cl.
CPC ..... *A63B 21/0455* (2013.01); *A63B 21/4035* (2015.10); *A63B 71/0622* (2013.01); *A61H 2201/1215* (2013.01); *A61H 2201/1659* (2013.01); *A63B 2022/0094* (2013.01); *A63B 2071/009* (2013.01); *A63B 2071/0072* (2013.01); *A63B 2220/13* (2013.01)

(58) Field of Classification Search
CPC .... A61H 2201/1635; A61H 2201/5043; A61H 1/0214; A61H 2201/1463; A63B 21/4035; A63B 21/00181; A63B 21/0435; A63B 21/0455; A63B 71/0622; A63B 2022/0094; A63B 2071/0072; A63B 2071/009; A63B 2220/13; A63B 24/0087; A63B 2024/0068; A63B 2024/0093; A63B 71/04; A63B 23/12; A63B 21/0058; A63B 2220/833; A63B 2225/09
See application file for complete search history.

(56) References Cited

FOREIGN PATENT DOCUMENTS

| | | | |
|---|---|---|---|
| JP | 2011224048 | A | 11/2011 |
| JP | 2013128736 | A | 7/2013 |
| KR | 101555871 | A | 9/2015 |
| KR | 101620633 | B1 | 5/2016 |
| KR | 1020160141094 | A | 12/2016 |

* cited by examiner (a)

(b)

UPPER LIMB EXERCISE APPARATUS AND CONTROL METHOD THEREFOR

TECHNICAL FIELD

The present invention relates to an upper limb exercise apparatus, and more particularly, to a rehabilitation apparatus or robot for use in rehabilitation of an elderly or a patient by inducing a rehabilitation motion in an exercise area.

BACKGROUND ART

The upper limb rehabilitation apparatuses have been developed, which are applicable for the stroke patients who have been increasing as the society is moving into the aging or graying stage, and also for the increasing number of spinal cord injury patients in traffic accidents, and the patients who lack active mobility of their hands due to various diseases such as brain injury such as stroke, traumatic brain injury, cerebral palsy, or nervous system damage caused by spinal cord injury, and so on.

The related upper limb rehabilitation apparatus is configured such that rehabilitation procedure is mainly focused on movements of the upper arm such as shoulders and elbows, and the treatment is mostly performed in the form of performing a special motion on the work table. An example of such a related art is disclosed in Korean Patent No. 10-1620633.

To explain the related art briefly, the above Korean patent discloses an augmented reality-based upper limb rehabilitation apparatus including an upper limb apparatus module that is positioned to be visible through a transparent display unit and that supports an arm and a finger of a user to move, a sensor that is provided at an end of the upper limb apparatus module and detects a position and a movement of the finger of the user, and a controller that receives a signal from the sensor and analyzes whether a mission on an image provided through the transparent display unit is accomplished or not, and performance. The transparent display further includes a display support for supporting it to be tilted with respect to a horizontal plane at a predetermined height, and the sensor is embedded at a distal position of the finger supported by the upper limb apparatus module.

According to the related art with the configuration described above, when the mission is selected by the controller, a mission image in virtual environment is provided on the transparent display unit, and the user performs the mission in the real environment with the arms and fingers placed on the upper limb apparatus module. The Korean patent discloses that the arms and fingers placed on the upper limb apparatus module can be directly moved as intended by the user or can be automatically moved according to a program set by the controller, and also discloses implementations of various forms.

However, with such a related upper limb rehabilitation apparatus, there is a difficulty in exercising various arm muscles required for movements relating to daily life tasks because the arms of the user are allowed to move only on a plane parallel to the horizontal plane during exercise.

DETAILED DESCRIPTION

Technical Problem

It is an object of the present invention to provide an upper limb exercise apparatus that helps rehabilitation of a patient lacking hand mobility due to damage to the nervous system due to brain injury or spinal cord injury, and the like, so that the patient is able to independently perform daily activities.

In addition, it is an object of the present invention to provide an apparatus, which is an upper limb exercise robot and with which a user can perform upper limb exercise while holding an end-effector type apparatus handle of a robot arm that has a basically 5-bar link structure (parallogram structure) on a flat display parallel to the ground.

It is an object of the present invention to provide an upper limb exercise apparatus that can be easily used in a residence such as a home or a welfare center so as to provide a practical help to a disabled person with a chronic stroke who has returned to his or her home from a hospital.

Technical Solution

The present invention provides an upper limb exercise apparatus which may include: a base B; a frame 10 having one side thereof fixed to the base and having a variable tilting angle; a display 20 mounted on the frame and displaying a target pointer; 5-bar linkage-type movable parts 30, 40 positioned on the upper or lower side of the display and including a first link 30 and a second link 40 which are drivable, in which the first link 30 may include a 1-1 member 31 of which one end is attached to the frame and is rotationally driven, and a 1-2 member 33 of which one end is rotatably attached to the other end of the 1-1 member, and the other end has attached thereto a handle 50 gripped by a user, and the second link 40 may include a 2-1 member 41 of which one end is attached to the frame and is rotationally driven, and a 2-2 member 43 of which one end is rotatably attached to the other end of the 2-1 member, and the other end has attached thereto handle 50 gripped by a patient and the other end of the 1-2 member; and series elastic actuators 60 each attached to one end of the 1-1 member 31 and one end of the 2-1 member 41, and providing torque.

In addition, according to the present invention, in place of the series elastic actuators 60, actuators may be provided, each attached to the one end of the 1-1 member 31 and the one end of the 2-1 member 41, and providing torque, and an elastic spring S1 may be provided between the frame 10 and the 1-1 member 31 of the first link 30, and an elastic spring S2 may be provided between the frame 10 and the 2-1 member 41 of the second link 40.

In order to prevent breakage of the display due to gravity while the handle is gripped by the user, a ball roller may be provided under the handle, and a transparent display cover, on which the ball roller is movable in contact, may be positioned on an upper surface of the display.

The series elastic actuators 60 may include a motor 61; and a speed reducer 62 that reduces a rotational speed of the motor and delivers the reduced speed to the first link or the second link, and may further include a spring 63 and an encoder provided between the speed reducer and the first link or the second link, such that the torque after the speed reducer is smoothly delivered to the first link or the second link, and a tilting angle ($\theta$) of the frame may preferably be adjusted by 0° to 180°.

The upper limb exercise apparatus may further include a controller that controls a rotation of the series elastic actuators to move the handle to the position of the target pointer based on the position of the handle and the position of the target pointer.

In addition, the present invention provides a method for controlling the upper limb exercise apparatus, which may include: a first step of detecting the position of the target pointer on the display; a second step of detecting the position of the handle 50; a third step of providing torque to the 1-1 member and the 2-1 member by operating the series elastic actuators to move the position of the handle.

The method may further include a detection step of detecting for a predetermined time after the second step as to whether the handle is moved or not, and when the movement of the handle is not detected for the predetermined time in the detecting step, the process proceeds to the third step such that the handle is moved to the position of the target pointer to assist the movement of the user.

In addition, the present invention provides a method for controlling the upper limb exercise apparatus, which may include: a first step of detecting the position of the target pointer on the display; a second step of detecting the position of the handle 50; a third step of detecting a movement of the position of the handle by a user; and a fourth step of providing torque to the 1-1 member and the 2-1 member by operating the series elastic actuators to provide resistance to the movement of the position of the handle detected in the third step.

In addition, according to the present invention, an elastic spring S1 may be provided between the frame 10 and the 1-1 member 31 of the second link 30, and an elastic spring S2 may be provided between the frame 10 and the 2-1 member 41 of the second link 40. At this time, the motor may or may not be used.

In addition, according to the present invention, when using the elastic spring S3 connected to one of the four sides of the handle 50 and the frame 10, the user may perform a resistive exercise, while deviation to the direction of gravity due to the link weight, the weight of the user's arm, and the like can be compensated to some extent when the display is tilted.

Advantageous Effects

The present invention provides an upper limb exercise robot that includes series elastic actuators and a link member having a 5-bar link structure, thus providing an apparatus that can be easily used at homes for those with chronic stroke disorders, in which a tilting angle of the display can be adjusted as necessary, and at the same time, when the user turns 90° clockwise or counterclockwise from a position of facing directly at the display and sits, without having to add or modify mechanical configuration, the user can have the same result as if he or she is exercising at an adjusted rotating angle (Φ) of the display, so that various exercises are possible with one apparatus and simple structure, thereby obtaining the effect similar to that of exercising in three-dimensional space.

In addition, elastic bodies can be connected in series to the actuators of the 5-bar link structure apparatus to reduce the load on the apparatus that the user would otherwise has to bear and thus increase so-called back-drivability so that the user hardly feels the resistance of the apparatus, and the breakage of the actuators that can occur through the back-drive of the actuators can also be prevented, and accordingly, for the upper limb exercise, there is an effect of improved usability by the user who may have joint stiffness due to the disease.

Further, the present invention has an effect that, due to the elastic body attached to the frame and the handle of the upper limb exercise apparatus, the user can perform a resistive exercise, while deviation to the direction of gravity due to the link weight, the weight of the user's arm, and the like can be compensated to some extent when the display is tilted.

BEST MODE FOR INVENTION

The objectives, specific advantages and novel features of the present invention will become more apparent from the following detailed description and the preferred embodiments, which are associated with the accompanying drawings. In addition, terms described herein are terms defined in consideration of functions in the present invention, which may vary according to the intention or convention of a user or an operator. Therefore, definitions of these terms should be made based on the contents throughout the present specification.

Figure 1:
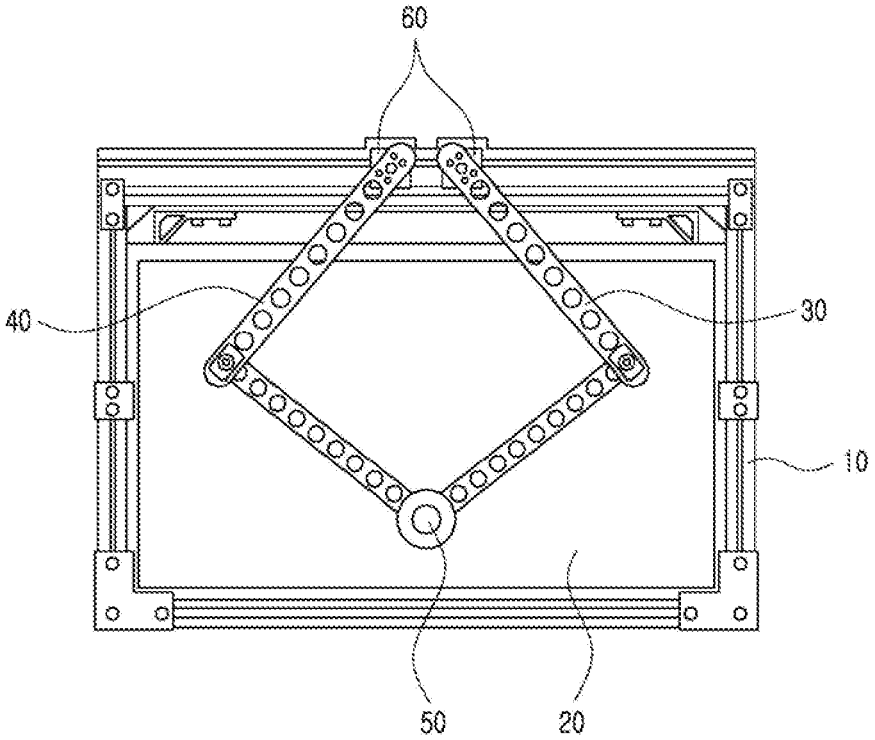
FIG. 1 is a plan view showing an upper limb exercise apparatus according to the present invention.
Figure 2A:
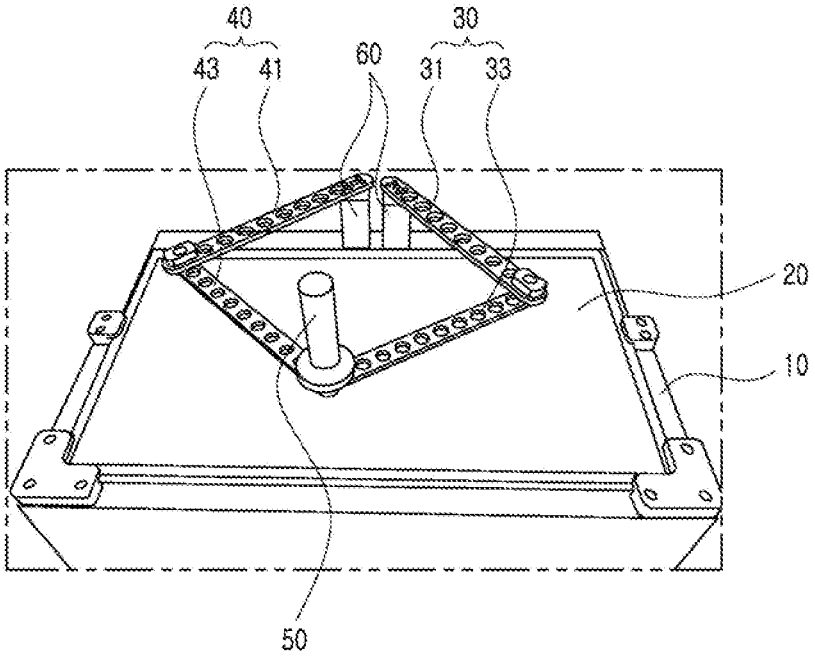
FIG. 2A is a perspective view showing the upper limb exercise apparatus according to the present invention.
Figure 2B:
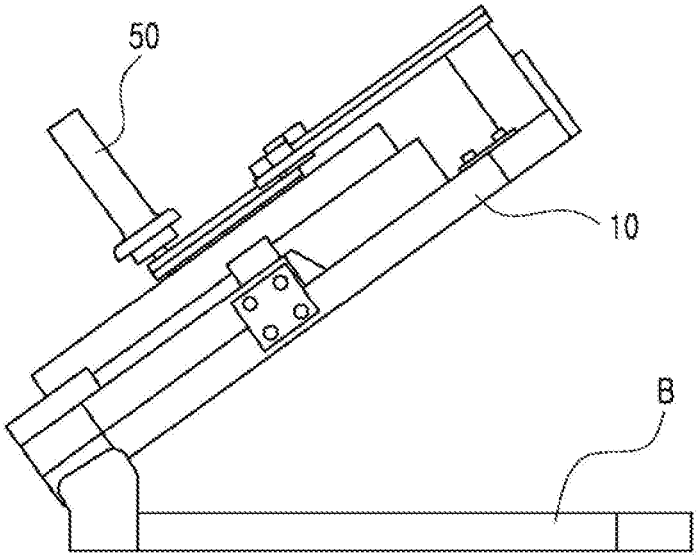
FIG. 2B is a side view showing the upper limb exercise apparatus according to the present invention.
Figure 3:
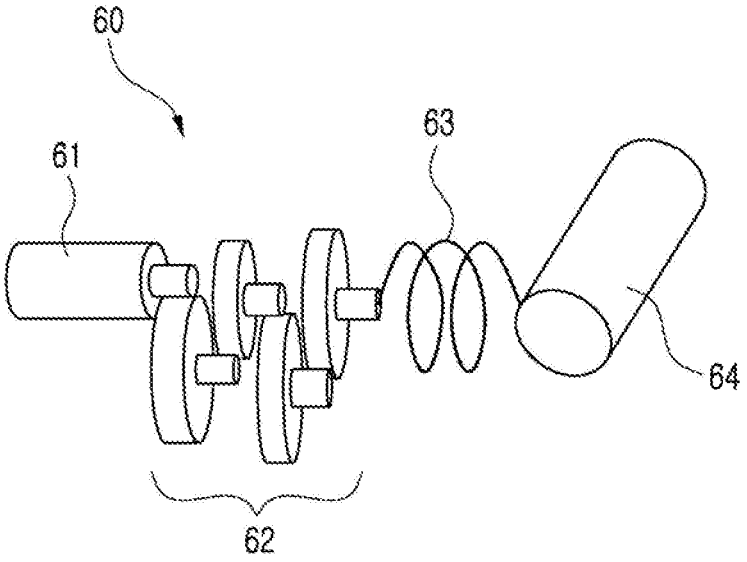
FIG. 3 is a schematic view showing a series elastic actuator of the upper limb exercise apparatus according to the present invention.
Figure 4A:
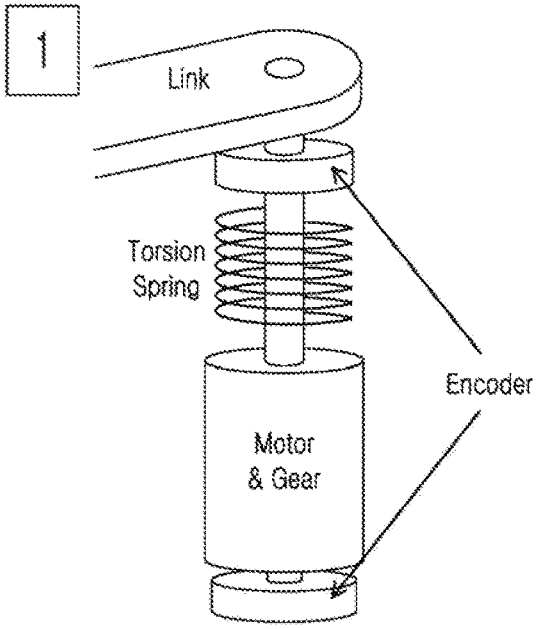
FIGS. 4A to 4C are views showing modified examples of the series elastic actuator according to the present invention.
Figure 4B:
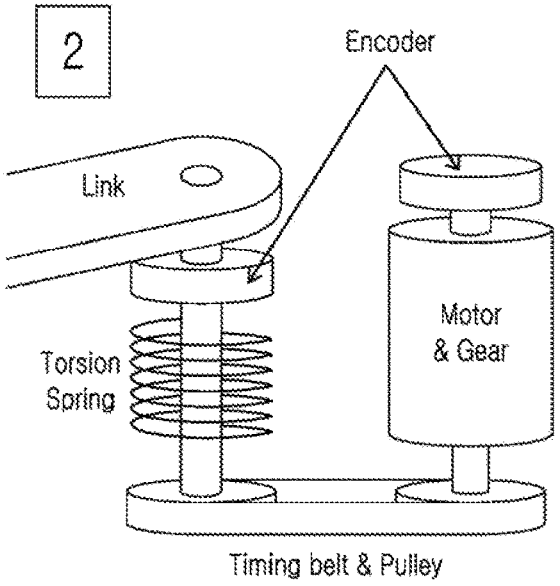
Figure 4C:
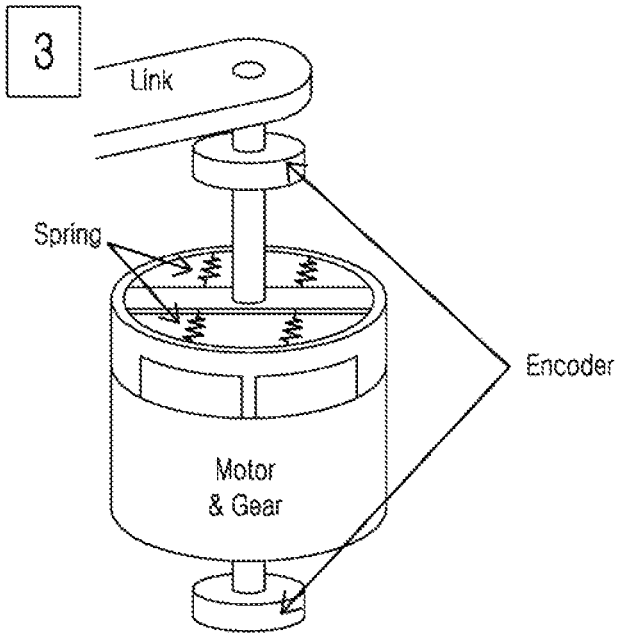
Figure 5:
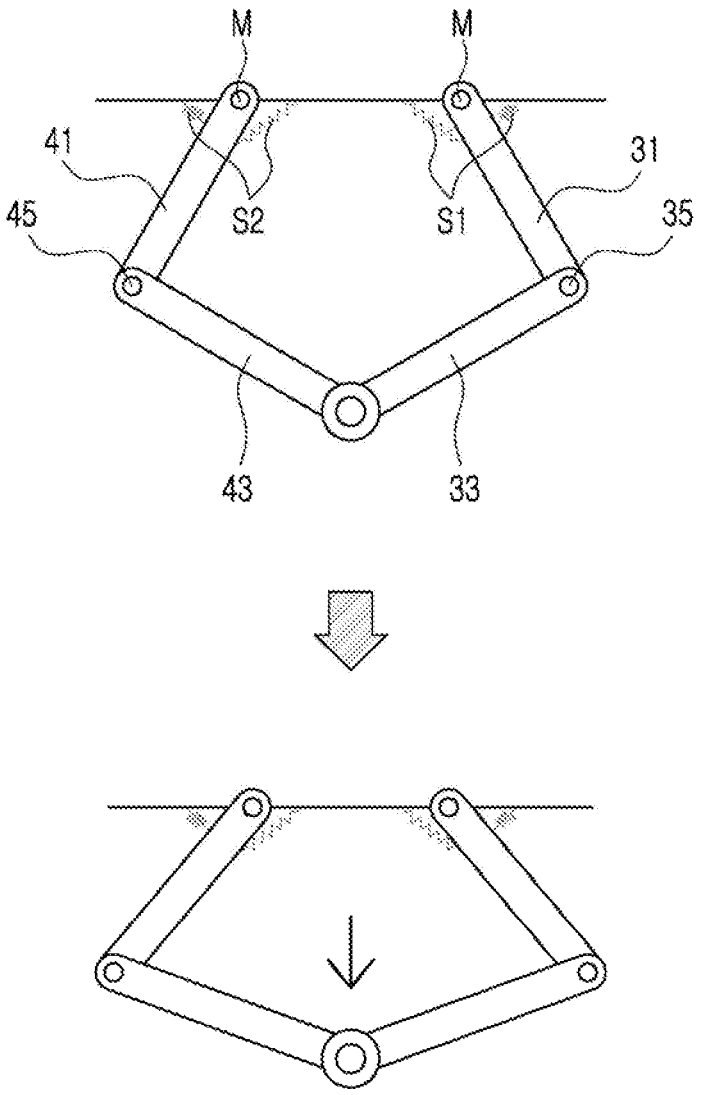
FIG. 5 shows elastic bodies attached to movable parts of 5-bar link shape of the upper limb exercise apparatus according to the present invention.
Figure 6:
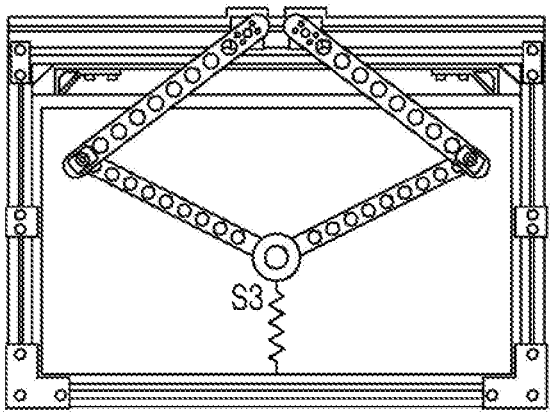
FIG. 6 shows an elastic body attached to a handle of the upper limb exercise apparatus according to the present invention.
Figure 6:
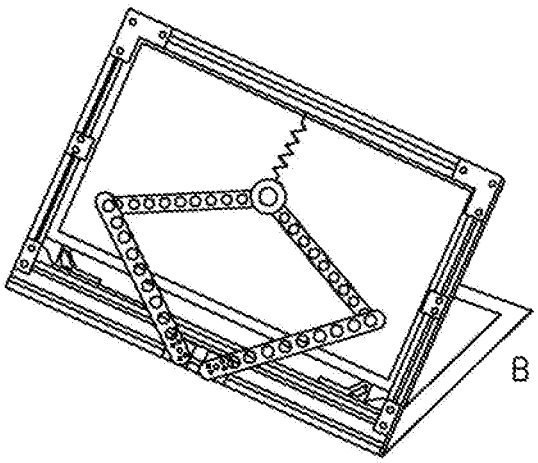
Figure 7:
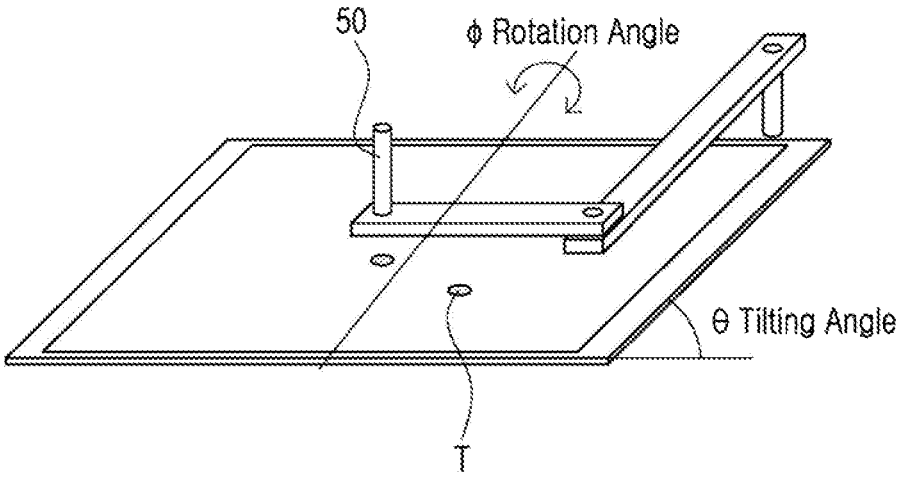
FIG. 7 shows a part of the configuration of the upper limb exercise apparatus according to the present invention.
Figure 8:
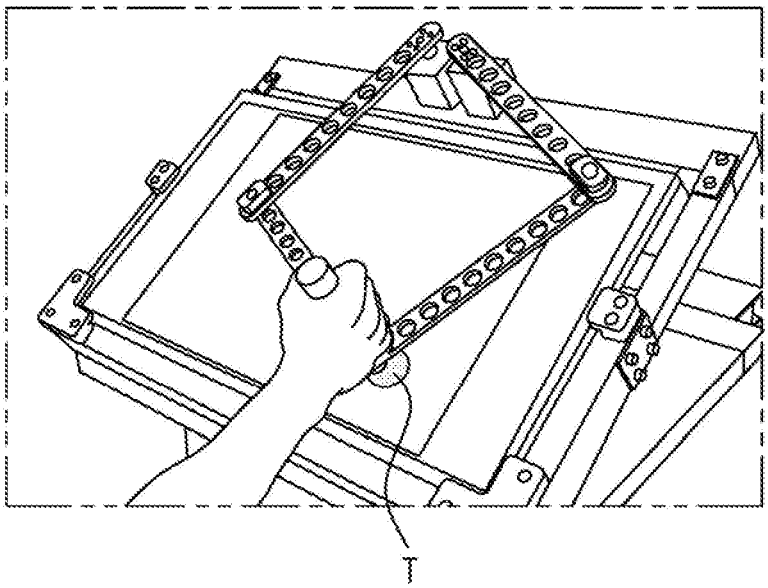
FIG. 8 shows the upper limb exercise apparatus in actual use according to the present invention.

FIG. 1 is a plan view showing an upper limb exercise apparatus according to the present invention, FIG. 2A is a perspective view showing the upper limb exercise apparatus according to the present invention, FIG. 2B is a side view showing the upper limb exercise apparatus according to the present invention, FIG. 3 is a schematic view showing a series elastic actuator of the upper limb exercise apparatus according to the present invention, FIGS. 4A to 4C are views showing modified examples of the series elastic actuator according to the present invention, FIG. 5 shows elastic bodies attached to movable parts of 5-bar link shape of the upper limb exercise apparatus according to the present invention, FIG. 6 shows an elastic body attached to a handle of the upper limb exercise apparatus according to the present invention, FIG. 7 shows a part of the configuration of the upper limb exercise apparatus according to the present invention, and FIG. 8 shows the upper limb exercise apparatus in actual use according to the present invention.

Hereinafter, the present invention will be described with reference to the drawings.

The upper limb exercise apparatus for home use according to the present invention should be mechanically simple, inexpensive and easy to use. Referring to FIGS. 1 to 2B, the upper limb exercise apparatus according to the present invention includes a base B, a frame 10 having one side thereof fixed to the base and having a variable tilting angle, a display 20 mounted on the frame and displaying a target pointer, and 5-bar linkage-type movable parts 30, 40 positioned on the upper or lower side of the display and including a first link 30 and a second link 40 which are drivable. In addition, the present invention includes a handle 50 to be gripped by a user (patient) by hand for upper limb exercise, and series elastic actuators 60 for providing the handle with auxiliary movement as assistance to the force of the user.

In the following description of the present invention, the apparatus is referred to as 'upper limb exercise apparatus' for convenience of description, but it may also be referred to as an 'upper limb exercise robot' as this is in the form of a robot or performs the functions of the robot. Therefore, in the following description, the two names refer to the same apparatus and are used interchangeably.

The first link 30 has a form in which a 1-1 member 31 and a 1-2 member 33 are connected to each other. The 1-1 member includes one end that is attached to the frame and is rotationally driven, and the 1-2 member includes one end that is attached rotatably to the other end of the 1-1 member by the first connection member 35 and the other end that has, attached thereto, the handle 50 gripped by a user. In addition, the second link 40 has a form in which a 2-1 member 41 and a 2-2 member 43 are connected to each other, and the 2-1 member 41 has one end attached to the frame and is rotatably driven, and the 2-2 member 43 has one end rotatably attached to the other end of the 2-1 member, and the other end has, attached thereto, the handle 50 gripped by the patient and the other end of the 1-2 member. In addition, the one end of the 1-1 member 31 and the one end of the 2-1 member 41 are provided with the series elastic actuators 60 for providing torques, respectively.

In addition, in order to prevent the breakage of the display due to gravity while the handle 50 is gripped by the user, a ball roller (not shown) is provided under the handle, and a transparent display cover, on which the ball roller is movable in contact, is positioned on an upper surface of the display.

The upper limb exercise robot for home use according to the present invention includes a flat panel display that provides visual information and allows to adjust a tilting angle θ as necessary. The tilting angle (θ of FIG. 7) of the frame is preferably adjusted by 0° to 180°. While the user's hand may be moved on the upper plane of the display during upper limb exercise, since the tilting angle of the display 20 of the upper limb exercise robot according to the present invention is adjustable, it is possible to obtain the similar effect as exercising in three-dimensional space by adjusting the display angle as necessary. In addition, the user with weak muscles can exercise in a basic posture that is parallel to the ground and without the tilting angle, after which the tilting angle may be gradually increased as the muscle strength increases, allowing the user to perform the upper limb exercise while overcoming gravity.

The flat display 20 is basically positioned under the handle and is disposed parallel to the ground, and may be positioned between the handle and the user's eyes to conceal the position of the handle and apply error augmentation with visual feedbacks.

A target pointer (T in FIG. 8) for the user to follow the same for the upper limb exercise is displayed on the display 20 of the upper limb exercise robot according to the present invention. The target pointer may be indicated by a red circle, for example. The user performs the upper limb exercise through a process of holding the handle 50 and moving the handle toward the target pointer T displayed on the display 20. The target pointer may be given randomly or may be displayed at a position of good exercise effect in consideration of the position of the handle. To this end, the controller further includes a controller that detects the position of the handle and the position of the target pointer and controls the rotation of the series elastic actuators to move the handle to the position of the target pointer based on the result of the detection.

However, rather than causing the handle to directly move to the target position, the controller according to the present invention waits for a movement of the handle 50 for a predetermined time after displaying the target pointer T on the display, and controls so that the handle is moved to the target pointer only when there is no movement of the handle. Note that the movement to the target pointer is not forced, but is performed by the force of the user and with the assistance of the robot. A predetermined time is given to wait for the user of the rehabilitation training in consideration of the user lacking ease of movement of his or her hand. That is, for the movement in which the user moves the handle to the target pointer point with his or her own force for a predetermined time, the user is let to move the handle by himself or herself without using external power to drive the handle. However, when it is detected that there is no movement of the handle for a predetermined time, it is determined that the user is not capable of moving the handle by his or her own force, and then the controller drives the series elastic actuators 60 to rotate the movable parts 30, 40 to assist the movement of the handle. The characteristic of the upper limb exercise robot control method according to the present invention is that it is attempted to, or not attempted to drive the external power (the series elastic actuators) after waiting for a predetermined time for the movement of the handle, in which the external power plays only a secondary role.

The series elastic actuators 60 of the upper limb exercise robot according to the present invention drive the first link 30 and the second link 40 to move the position of the handle 50, in which the series elastic actuator includes a motor 61 and a speed reducer 62 which reduces the rotational speed of the motor and delivers the reduced speed to the first link or the second link, and further includes a spring 63 and an encoder provided between the speed reducer and the first link or the second link. The speed reducer reduces the speed with a plurality of connected gears, and during this speed reduction process, the number of revolutions decreases but the torque is increased and may become extreme, and therefore, the spring 63 is provided to compensate for this so that the torque is smoothly delivered to the first link or the second link. The encoder is connected to the first link or the second link and is provided to determine the actual angle at which the link is rotated.

The controller according to the present invention is capable of processing incoming analog and digital sensor signals and is also capable of outputting a rotation angle of the series elastic actuators and rotation torque command. The position of the distal end (handle 50) may be controlled through the control of the series elastic actuators connected to the 5-bar link structure upper limb exercise robot, and when controlling the series elastic actuators, an amount of displacement of the series-connected elastic bodies may also be measured with a value of the encoder that is connected to the link. The controller calculates the positions (rotation angles) of two series elastic actuators and controls the handle to follow the upper limb movement so that the handle is in the same position as the user's hand according to the user's upper limb movement, thereby assisting the movement of the user. In addition, since the elastic bodies (springs) are connected in series, by measuring and controlling the amounts of displacement of the elastic bodies compared to the series elastic actuators according to the user's upper limb movement, it is possible to make the user hardly feel the resistance of the structure or to implement a haptic function that generates a certain sense of resistance. In addition, the series elastic actuator may include an elastic body attached between the actuator and the link to reduce the mechanical load that the user and the actuator would otherwise have to bear, thereby preventing the breakage of the actuator that may occur due to the back-drive of the actuator.

The form of the series elastic actuator may be configured in various ways as shown in FIGS. 4A to 4C. FIG. 4A shows an example of a configuration in which axes of the link, the torsion spring, and the encoder of the motor are aligned in a line, FIG. 4B shows an example of a configuration of further adding a timing belt and pulley, and FIG. 4C shows an example of a configuration in which a different type of spring is used instead of a torsion spring to perform the same function.

In another embodiment, as shown in FIG. 5, without using the series elastic actuators, only the elastic bodies are attached to the links, thereby preventing the breakage of the actuators that may occur due to the back-drive of the actuators. As shown in FIG. 5, an elastic spring S1 may be disposed between the frame 10 and the 1-1 member 31 of the first link 30, and an elastic spring S2 may be disposed between the frame 10 and the 2-1 member 41 of the second link 40. Each link is fixed in position and restricted from moving when the actuator is stopped, but attaching the elastic bodies can physically protect the actuator when an unexpected external force occurs, since this allows the link to be moved slightly due to the elastic force of the elastic body.

In addition, FIG. 6 shows the elastic body attached to the handle of the upper limb exercise robot according to the present invention. By attaching the elastic spring S3 to the handle, the handle does not fall, but is maintained at a predetermined point by the elastic force of the spring even when the user temporarily releases the handle while using the upper limb exercise robot or when the frame 10 is tilted. That is, the present invention has an effect that, due to the elastic body attached to the frame and the handle of the upper limb exercise robot, the user can perform a resistive exercise, while deviation to the direction of gravity due to the link weight, the weight of the user's arm, and the like can also be compensated to some extent when the display is tilted.

In this case, since the force to return to the basic position of the elastic body is continuously acting on the handle by the elastic force of the elastic body, the user can perform a resistive exercise. When the motor is not used and only the elastic body is disposed on the link, the user would not be aided with the auxiliary force of the motor, but the user is still able to perform the resistive exercise depending on how the elastic body is disposed, and the gravity compensation is also performed to some extent by the elastic force of the elastic body when the tilting angle of the display is changed, thus allowing the user to exercise more comfortably.

When the user of the upper limb exercise robot according to the present invention is not able to reach the target position for slightly lacking muscle strength during the upper limb exercise, he or she can be aided with the force of the motor so that he or she can move the handle to the target position, while, on the contrary, the user may be allowed to perform the upper limb exercise against resistance from the motor when he or she does not need the assistance force. In addition, when the user turns 90° clockwise or counterclockwise from a position of facing directly at the display and sits, without having to modify the mechanical configuration, the user can have the same result as if he or she is exercising at an adjusted rotating angle (Φ in FIG. 7) of the display, so that various exercises are possible with one apparatus and simple structure.

Further, according to the present invention, the handle may be disposed under the display so as to apply the error augmentation which is widely used in the recent rehabilitation exercise. Since the position of the handle is under the display, the user cannot know exactly where his or her hand is. Therefore, an effect of the rehabilitation of the user can be increased through visual feedback that augments the error of the hand position that follows the target pointer. The present invention provides an upper limb exercise robot having the series elastic actuators and the link structure that can be easily used at homes for those with chronic stroke disorders to provide the user with an effect similar to that of exercising in three-dimensional space by adjusting the tilt angle of the display as necessary.

In summary, a method for controlling the upper limb exercise robot according to the present invention includes a first step of detecting a position of the target pointer on the display; a second step of detecting a position of the handle 50; and a third step of providing torque to the 1-1 member and the 2-1 member by operating the series elastic actuators to move the position of the handle, and further includes a detection step of detecting for a predetermined time after the second step as to whether the handle is moved or not, in which when the movement of the handle is not detected for the predetermined time in the detecting step, the process proceeds to the third step such that the handle is moved to the position of the target pointer to assist the movement of the user.

In addition, the present invention provides a method for controlling the upper limb exercise robot, which includes a method of giving a resistance including: a first step of detecting a position of the target pointer on the display; a second step of detecting a position of the handle 50; and a third step of detecting a movement of the position of the handle by a user; and a fourth step of providing torque to the 1-1 member and the 2-1 member by operating the series elastic actuators to provide resistance to the movement of the position of the handle detected in the third step.

The present invention has been described in detail. However, it should be understood that the detailed description and specific examples, while indicating preferred embodiments of the invention, are given by way of illustration only, since various changes and modifications within the scope of the invention will become apparent to those skilled in the art from this detailed description.

The invention claimed is:

1. An upper limb exercise apparatus comprising:

a base (B);

a frame (10) having one side thereof fixed to the base and having a variable tilting angle;

a display (20) mounted on the frame and displaying a target pointer;

5-bar linkage-type movable parts (30, 40) positioned on an upper or lower side of the display and including a first link (30) and a second link (40) which are drivable, wherein the first link (30) comprises a 1-1 member (31) having one end attached to the frame and being rotationally driven, and a 1-2 member (33) having one end rotatably attached to another end of the 1-1 member, another end of the 1-2 member (33) having attached thereto a handle (50) configured to be gripped by a user, and the second link (40) comprises a 2-1 member (41) having one end attached to the frame and being rotationally driven, and a 2-2 member (43) having one end rotatably attached to another end of the 2-1 member, another end of the 2-2 member (43) having attached thereto the handle (50) and the other end of the 1-2 member; and two series elastic actuators (60) respectively attached to the one end of the 1-1 member (31) and the one end of the 2-1 member (41), and providing torque.

2. The upper limb exercise apparatus of claim 1, wherein, in order to prevent breakage of the display due to gravity while the handle is gripped by the user, a ball roller is provided under the handle, and a transparent display cover, on which the ball roller is movable in contact, is positioned on an upper surface of the display.

3. The upper limb exercise apparatus of claim 1, wherein the series elastic actuators (60) include a motor (61), and a speed reducer (62) that reduces a rotational speed of the motor and delivers the reduced speed to the first link or the second link, and further include a spring (63) and an encoder provided between the speed reducer and the first link or the second link, such that the torque after the speed reducer is smoothly delivered to the first link or the second link.

4. The upper limb exercise apparatus of claim 1, wherein a tilting angle θ of the frame is adjustable manually or electrically and is adjusted by 0° to 180°.

5. The upper limb exercise apparatus of claim 1, further comprising a controller that controls a rotation of the series elastic actuators to move the handle to a position of the target pointer based on a position of the handle and the position of the target pointer.

6. A method for controlling an upper limb exercise robot of the upper limb exercise apparatus according to claim 1, comprising:

a first step of detecting a position of the target pointer on the display;

a second step of detecting a position of the handle (50); and a third step of providing torque to the 1-1 member and the 2-1 member by operating the series elastic actuators to move the position of the handle.

7. The method of claim 6, further comprising a detection step of detecting for a predetermined time after the second step as to whether the handle is moved or not.

8. The method of claim 7, comprising, when not detecting the movement of the handle for the predetermined time in the detecting step, proceeding to the third step such that the handle is moved to the position of the target pointer, wherein the movement to the target pointer is not forced, but by a force of the user with assistance of the robot.

9. The upper limb exercise apparatus of claim 1, further comprising an elastic spring (S3) for connecting the handle with the frame.

10. A method for controlling an upper limb exercise robot of the upper limb exercise apparatus according to claim 1, comprising:

a first step of detecting a position of the target pointer on the display;

a second step of detecting a position of the handle (50);

a third step of detecting a movement of the position of the handle by a user; and a fourth step of providing torque to the 1-1 member and the 2-1 member by operating the series elastic actuators to provide resistance to the movement of the position of the handle detected in the third step.

11. The method of claim 10, wherein an error augmentation is applied to the position of the target pointer with a visual feedback.

12. An upper limb exercise apparatus comprising:

a base (B);

a frame (10) having one side thereof fixed to the base and having a variable tilting angle;

a display (20) mounted on the frame and displaying a target pointer; and 5-bar linkage-type movable parts (30, 40) positioned on an upper or lower side of the display and including a first link (30) and a second link (40) which are drivable, wherein the first link (30) comprises a 1-1 member (31) having one end attached to the frame and being rotationally driven, and a 1-2 member (33) having one end rotatably attached to another end of the 1-1 member, another end of the 1-2 member (33) having attached thereto a handle (50) configured to be gripped by a user, the second link (40) comprises a 2-1 member (41) having one end attached to the frame and being rotationally driven, and a 2-2 member (43) having one end rotatably attached to another end of the 2-1 member, another end of the 2-2 member (43) having attached thereto the handle (50) and the other end of the 1-2 member, two actuators are respectively attached to the one end of the 1-1 member (31) and the one end of the 2-1 member (41), and provide torque, an elastic spring (S1) is provided between the frame (10) and the 1-1 member (31) of the first link (30), and an elastic spring (S2) is disposed between the frame (10) and the 2-1 member (41) of the second link (40).

13. The upper limb exercise apparatus of claim 12, further comprising an elastic spring (S3) for connecting the handle with the frame.

14. An upper limb exercise apparatus comprising:

a base (B);

a frame (10) having one side thereof fixed to the base and having a variable tilting angle;

a display (20) mounted on the frame and displaying a target pointer; and 5-bar linkage-type movable parts (30, 40) positioned on an upper or lower side of the display and including a first link (30) and a second link (40), wherein the first link (30) comprises a 1-1 member (31) having one end attached to the frame and being rotationally driven, and a 1-2 member (33) having one end rotatably attached to another end of the 1-1 member, another end of the 1-2 member (33) having attached thereto a handle (50) configured to be gripped by a user, and the second link (40) comprises a 2-1 member (41) having one end attached to the frame and being rotationally driven, and a 2-2 member (43) having one end rotatably attached to another end of the 2-1 member, another end of the 2-2 member (43) having attached thereto the handle (50) and the other end of the 1-2 member, an elastic spring (S1) is provided between the frame (10) and the 1-1 member (31) of the first link (30), and an elastic spring (S2) is disposed between the frame (10) and the 2-1 member (41) of the second link (40).

15. The upper limb exercise apparatus of claim 14, further comprising an elastic spring (S3) for connecting the handle with the frame.

* * * * *